US005531151A

United States Patent [19]

Matsui

[11] Patent Number: 5,531,151

[45] Date of Patent: Jul. 2, 1996

[54] RODLESS CYLINDER

[75] Inventor: Akio Matsui, Gifu, Japan

[73] Assignee: Festo KG, Esslingen, Germany

[21] Appl. No.: 364,391

[22] Filed: Dec. 27, 1994

Related U.S. Application Data

[63] Continuation of Ser. No. 769,184, Sep. 30, 1991, abandoned.

[30] Foreign Application Priority Data

Feb. 19, 1991 [JP] Japan ..... 3-023639

[51] Int. Cl.[6] ..... F01B 29/00

[52] U.S. Cl. ..... 92/88; 277/DIG. 7

[58] Field of Search ..... 92/88; 277/DIG. 7

[56] References Cited

U.S. PATENT DOCUMENTS

| | | | |
|---|---|---|---|
| 4,685,383 | 8/1987 | Ruchser | 277/DIG. 7 X |
| 4,733,604 | 3/1988 | Lipinski | 92/88 |
| 4,991,494 | 2/1991 | Migliori | 92/88 |

FOREIGN PATENT DOCUMENTS

| | | |
|---|---|---|
| 0033541 | 8/1991 | European Pat. Off. . |
| 1475809 | 3/1969 | Germany . |
| 436617 | 11/1967 | Switzerland . |
| 470088 | 8/1937 | United Kingdom . |
| 2163499 | 2/1986 | United Kingdom . |
| 22025887 | 9/1988 | United Kingdom . |

OTHER PUBLICATIONS

Japanese Gazette No. 1–320305, "Device To Stop Cylinder", Dec. 26, 1989.

Japanese Gazette No. 1–108404, "Rodless Cylinder", Apr. 25, 1989.

Japanese Gazette No. 64–25507, "Rodless Cylinder", Feb. 13, 1989.

Japanese Gazette No. 63–96305, "Rodless Cylinder", Apr. 27, 1988.

Japanese Gazette No. 63–57801, "Rodless Cylinder", Apr. 18, 1988.

Japanese Gazette No. 62–184208, "Rodless Cylinder", Aug. 12, 1987.

Japanese Gazette No. 62–56606, "Device To Stop Cylinder", Mar. 12, 1987.

Japanese Gazette No. 61–233209, "Device To Stop Cylinder", Oct. 17, 1986.

Japanese Gazette No. 61–141894, "Hose Joint", Sep. 2, 1986.

Japanese Gazette No. 61–141802, "Rotary Actuator", Sep 2, 1986.

Japanese Gazette No. 61–79072, "Rodless Cylinder", Apr. 22, 1986.

Japanese Gazette No. 59–83810, "Device To Stop Cylinder", May 15, 1984.

Japanese Gazette No. 57–185909, "Detecting Device Of Cylinder Rod Position", Nov. 25, 1982.

*Primary Examiner*—Hoang Nguyen

*Attorney, Agent, or Firm*—Hoffmann & Baron

[57] ABSTRACT

A rodless cylinder which is capable of minimizing the leak of pressure fluid from a cylinder tube. A slit of an almost trapezoidal section is formed in the cylinder tube in a longitudinal direction thereof, a trapezoidal belt which is fixed to the ends of the cylinder tube at the both ends thereof is fitted into the slit, the trapezoidal belt slidably passes through a piston which is fitted into the cylinder tube, and a piston cup is fitted on the outer periphery of the piston. In addition, ribs are provided between an outer lip of the piston cup which is in abutment against the vicinity of the both sides of the bottom of the trapezoidal belt and an inner lip of the piston cup, and the both side walls of tile slit of the almost trapezoidal section are formed into convexly curved configurations in such a manner that the both side walls of the slit can be connected to the inner peripheral surface of the cylinder tube forming a smooth curve. And, on the both upper side walls of the slit, there are provided projection strips for nipping and holding the trapezoidal belt therebetween.

3 Claims, 3 Drawing Sheets

RODLESS CYLINDER

This is a continuation of U.S. patent application Ser. No. 07/769,184 filed on Sep. 30, 1991, now abandoned.

BACKGROUND OF THE INVENTION

The present invention relates to a rodless cylinder, that is, a cylinder with no piston rod, and more particularly to a rodless cylinder which is capable of minimizing the leak of pressure fluid.

Conventionally, there has been known a rodless cylinder of the type which is constructed such that a slit of a trapezoidal section is formed in a cylinder tube in a longitudinal direction thereof, a trapezoidal belt which is fixed to the ends of the cylinder tube at the both ends thereof is fitted into the slit, and the trapezoidal belt is brought into engagement with a piston which is slidably inserted and fitted into the cylinder tube so as to seal the slit in the cylinder tube with the trapezoidal belt.

However, the conventional rodless cylinder of the above mentioned type has such a drawback that an area between the piston and the inner peripheral surface of the cylinder tube is sealed with a piston cup (a ring-type lip packing) which is fitted onto the outer periphery of the piston, and a part of the piston cup which is in press contact with the horizontal plane of the bottom of the trapezoidal belt deforms with a curvature which is different from that of the inner peripheral surface of the cylinder tube, or when the trapezoidal belt is fitted into the slit, the trapezoidal belt does not align with the bottom of the slit due to the tolerance in size and hence a level difference is induced between the bottom of the trapezoidal belt and the inner peripheral surface of the cylinder tube, so that the pressure fluid which is applied into the cylinder tube leaks out through the gap created by the level difference.

Accordingly, the inventors of the present invention have proposed a rodless cylinder of the structure as shown in FIG. 9 in Japanese Laid Open Patent Specification No. 184208/87. This rodless cylinder is constructed such that a rib 21*c* is provided between outer lip 21*a* and inner lip 21*b* of a piston cup 21 which is fitted onto the outer periphery of a piston 20 in such a manner that the outer lip 21*a* is pushed against the inner peripheral surface of a cylinder tube 22 by the rib 21*c*. Further, the rodless cylinder is constructed such that concavely curved surfaces are formed on the both sides of a trapezoidal belt 23 in such a manner that when the base of the trapezoidal belt 23 is pushed by the piston cup 21, the base can be readily deformed after the curve of the inner peripheral surface of the cylinder to prevent the outer lip 21*a* from being inclined, thereby to reduce the leak of the pressure fluid.

However, the above mentioned conventional rodless cylinder has such a drawback that as shown in FIG. 10. an angulated portion A is formed in a position of the trapezoidal belt 23 entering a slit 24 from the inner peripheral surface of the cylinder tube 22, so that a lower angulated portion of the trapezoidal belt 23 slightly projects inwardly from the inner peripheral surface of the cylinder tube to induce a level difference due to the tolerance in size of the trapezoidal belt 23 and the slit 24, a gap C is created between the outer lip 21*a* of the piston cup 21 and the inner peripheral surface of the cylinder tube and hence the pressure fluid is liable to leak through the gap C.

Therefore, there has been demanded a rodless cylinder which is constructed so as to further reduce the leak of the pressure fluid out of the cylinder tube 22.

SUMMARY OF THE INVENTION

The present invention bas been contemplated in order to solve the above mentioned problems associated with the prior arts. Accordingly, an object of the present invention is to provide a rodless cylinder which is capable of minimizing the leak of the pressure fluid from within the cylinder tube.

In order to attain the above mentioned object, according to the present invention, there is provided a rodless cylinder of the type in which a slit which is almost trapezoidal in section is formed in a cylinder tube so as to extend in a longitudinal direction thereof, a trapezoidal belt which is fixed to the ends of the cylinder tube at the both ends thereof is fitted into the slit and the trapezoidal belt slidably passes through a piston which is fitted into the cylinder tube, and a piston cup is fitted onto the outer periphery of the piston and characterized in that ribs are provided between an outer lip and an inner lip of a piston cup which is in abutment against the vicinity of the both sides of the bottom of the trapezoidal belt, and the both side walls of the slit of the almost trapezoidal section are formed into convexly curved configurations in such a manner that the both side walls of the slit can be connected to the inner peripheral surface of the cylinder tube forming a smooth curve, and projection strips for nipping and holding the trapezoidal belt therebetween are formed on the both upper side walls of the slit of the almost trapezoidal section.

The rodless cylinder according to the present invention operates as follows.

The piston cup is fitted onto the outer periphery of the piston and the ribs are provided between the outer lip and the inner lip of the piston cup which is in abutment against the vicinity of the both sides of the bottom of the trapezoidal belt, so that even in a state that the outer lip is pushed against the bottom of the trapezoidal belt and inclined, the outer lip which abuts against the vicinity of the both sides of the bottom of the trapezoidal belt is pushed against the cylinder inner peripheral surface by the ribs so as to restrict the formation of a gap which is otherwise liable to be formed between the outer lip and the cylinder inner peripheral surface, thereby minimizing the leak of the pressure fluid.

In addition, the both side walls of the slit of the almost trapezoidal section are formed into the convexly curved configurations and the both side walls of the slit can be connected to the inner peripheral surface of the cylinder tube forming the smooth curve, so that even when the trapezoidal belt is not correctly fitted into the slit and hence the lower angulated portion of the trapezoidal belt slightly projects inwardly from the inner peripheral surface of the cylinder tube due to the tolerance in size of the trapezoidal belt and the slit and due to the intervention of dust and the like therebetween, no gap is formed between the outer lip of the piston cup and the inner peripheral surface of the cylinder tube and hence the leak of the pressure fluid out of the cylinder tube can be further reduce.

Finally, projection strips for nipping and holding the trapezoidal belt therebetween are formed on the both upper side walls of the slit of the almost trapezoidal section, so that the trapezoidal belt which is in a position separated from the piston within the cylinder tube can be nipped in the projection strips to be correctly held within the slit, thereby preventing the belt from hanging down into the cylinder tube to reduce the leak of the pressure fluid through the slit.

The novel features that are considered characteristic of this invention are set forth with particularity in the appended claim. The invention will best be understood from the following description when read in connection with the accompanying drawings.

DESCRIPTION OF A PREFERRED EMBODIMENT OF THE INVENTION

Next, an embodiment of the present invention will be described with reference to the accompanying drawings.

Figure 1:
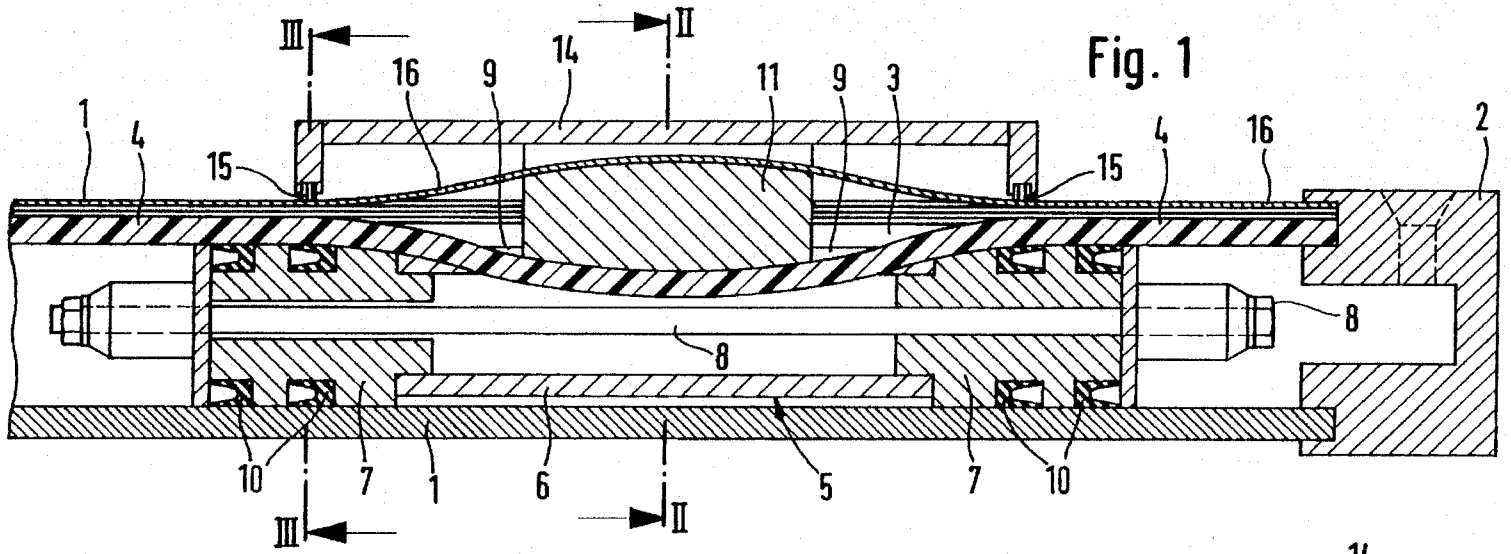
FIG. 1 is a sectional view of a rodless cylinder according to an embodiment of the present invention.

FIG. 1 is a sectional view of a rodless cylinder. In the drawing, a cylinder tube 1 is closed by head covers 2 at the both ends thereof and one slit 3 is formed in an upper portion of the cylinder tube 1 in a longitudinal direction so as to have an almost trapezoidal sectional configuration in which the outer periphery thereof is defined as the upper base (shorter side).

Figure 4:
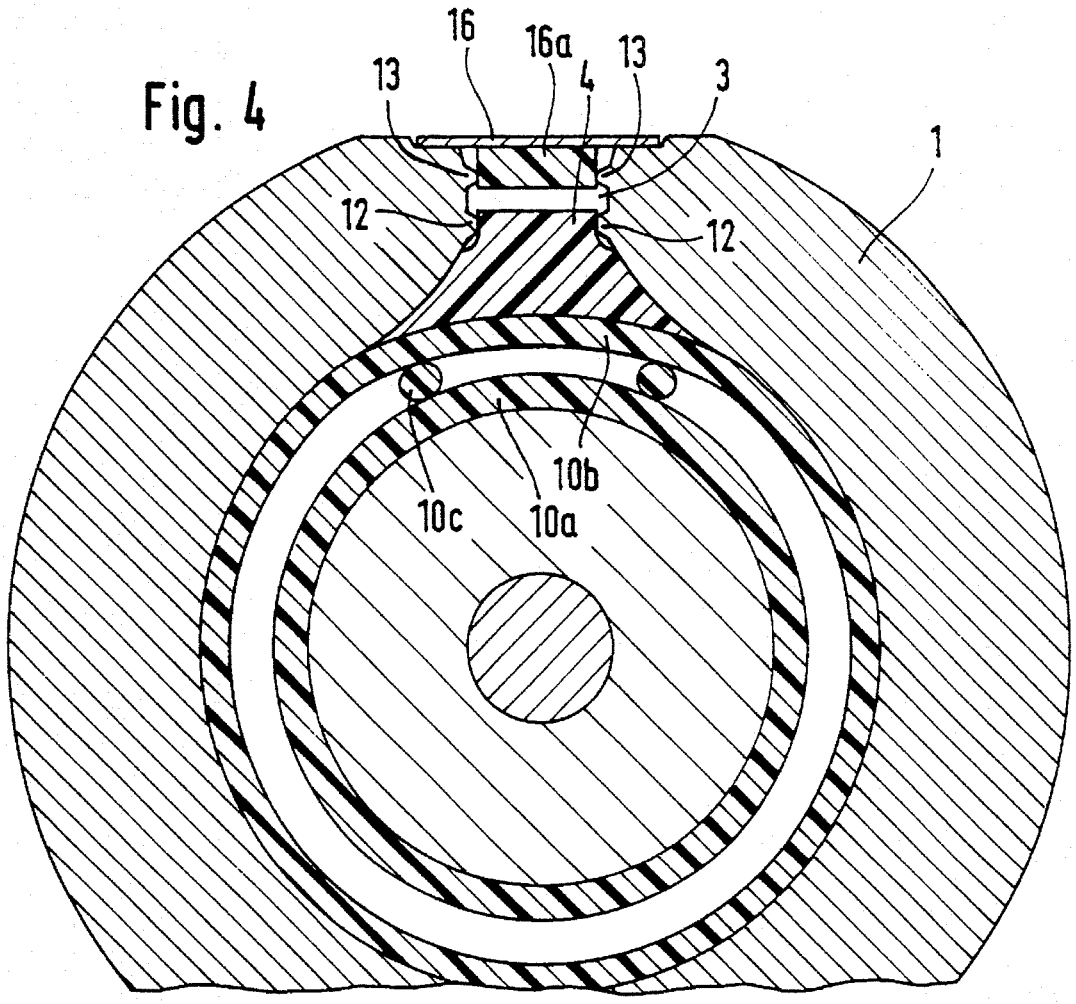
FIG. 4 is an enlarged cross sectional view of the cylinder in FIG. 1.

As shown in FIG. 4, the both side walls of the slit 3 of the almost trapezoidal section are formed into convexly curved configurations such that the both side walls of the slit 3 are connected to the inner peripheral surface of the cylinder tube 1 forming a smooth curve. In addition, on the upper both side walls of the slit 3, there are formed projection strips 12, 12 for nipping and holding the trapezoidal belt 4 and projection strips 13, 13 for nipping and holding a dust seal belt 16 in a longitudinal direction.

Figure 5:
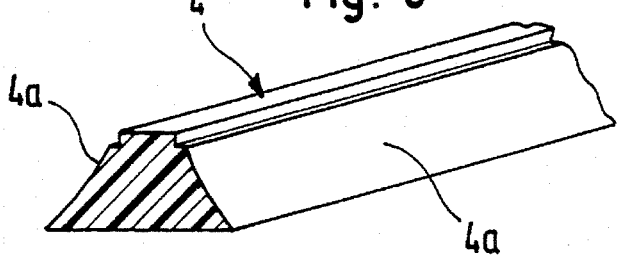
FIG. 5 is a perspective view of a trapezoidal belt 4.

The trapezoidal belt 4 is a belt which is fitted into the slit 3 from the inside. The trapezoidal belt 4 is provided with projections to be nipped between the above mentioned projection strips on upper portions thereof and is fixed to the both ends of the cylinder tube 1 at the both ends thereof. The trapezoidal belt 4 is made of synthetic resin and/or other reinforcing material so as to afford proper elasticity and flexibility and favorable slidability. Further, the trapezoidal belt 4 is formed such that as shown in FIG. 5, the both sides which spread out in a fan-shape from the top toward the bottom thereof are shaped into the concavely curved surfaces 4*a*.

A piston 5 which is to be inserted and fitted into the cylinder tube 1 is constructed such that end blocks 7 are put on the both ends of a tubular main body 6 and the end blocks or other members are fixedly clamped by a through bolt 8 which passes through the center of the main body 6. Piston cups 10 are fitted into ring-shaped grooves which are indented in the outer periphery of the end block 7 two by two on the both sides thereof. In the upper part of the tubular main body 6, there is pierced an insertion hole 9 through which the trapezoidal belt 4 obliquely goes into and out in the longitudinal direction of the main body. On an upper central part of the tubular main body 6, there is projectingly provided a coupling member 11 which projects from the slit 3 toward the outside.

Figure 2:
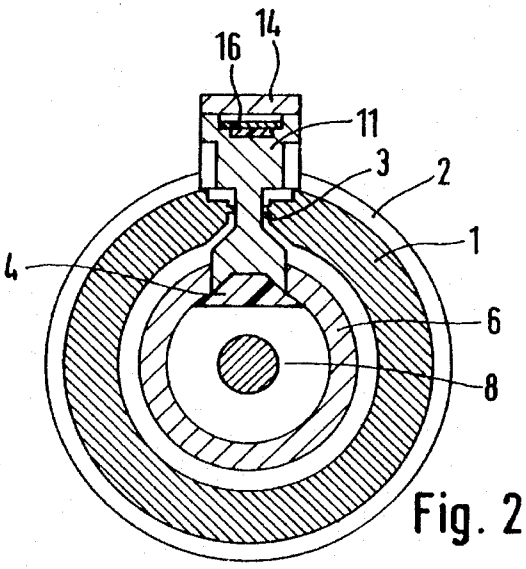
FIG. 2 is a sectional view taken along the line II—II in FIG. 1.

In addition to the above, in a part of the end block 7, there is also provided a groove which is designed in such a manner that the base of the trapezoidal belt 4 can smoothly slides therealong and in a lower part of the coupling member 11, there is also provided a groove which is designed in such a manner that as shown in FIG. 2, the trapezoidal belt 4 can smoothly slides therealong. Further, in an upper part of the coupling member 11, there is provided a groove along which the dust seal belt 16 can slide.

Figure 6:
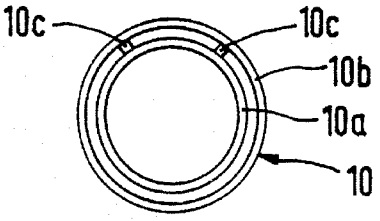
FIG. 6 is a front view of a piston cup 10.
Figure 7:
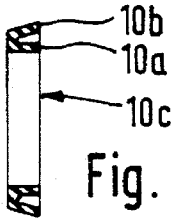
FIG. 7 is a sectional view of the piston cup 10.

The piston cup 10 is made of a high polymer elastomer such as synthetic rubber or the like and is provided with inner lip 10*a* and outer lip 10*b* as shown in FIGS. 6 and 7 and two ribs 10*c* are provided in predetermined positions between the inner lip 10*a* and the outer lip 10*b*.

Figure 3:
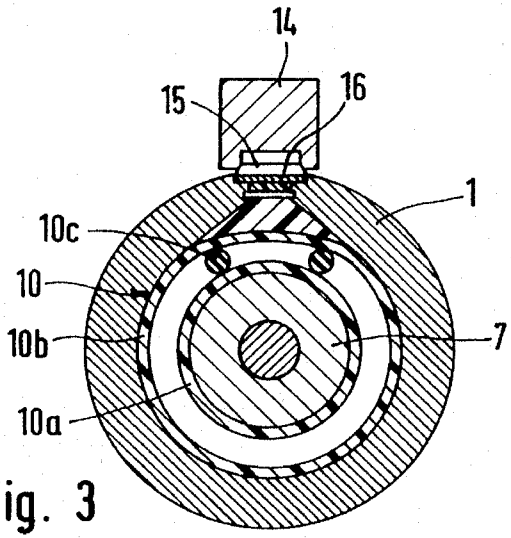
FIG. 3 is a sectional view taken along the line III—III in FIG. 1.

The above mentioned two ribs 10*c* are provided in order to avoid the formation of gap due to too much bending of the outer lip 10*b* which is brought into abutment against the vicinity of both of the sides of the bottom of the trapezoidal belt 4 or a level difference between the bottom of the trapezoidal belt 4 and the inner periphery of the cylinder tube 1 caused by the tolerance in size of the trapezoidal belt 4 and the slit 3 in a case that the upper part of the piston cup 10 is pushed against the bottom of the trapezoidal belt 4 to be deformed as shown in FIG. 3 and hence is provided between the outer lip 10*b* which is in abutment against the vicinity of the both sides of the bottom of the trapezoidal belt 4 and the inner lip 10*a*. The ribs 10*c* may be molded integrally with the piston cup upon the manufacture thereof or may be provided on the piston cup later by fitting members of proper size into predetermined positions in the piston cup and adhering the same thereto.

A plate 14 is horizontally fixed onto the coupling member 11 projecting upward from the slit 3 in the cylinder tube 1 and dust scrapers 15 which slide along a dust seal belt 16 while pressing down the belt 16 are attached to the front and rear of the plate 14.

Figure 8:
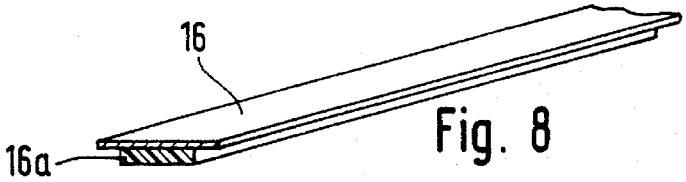
FIG. 8 is a perspective view of a dust seal belt 16.
Figure 9:
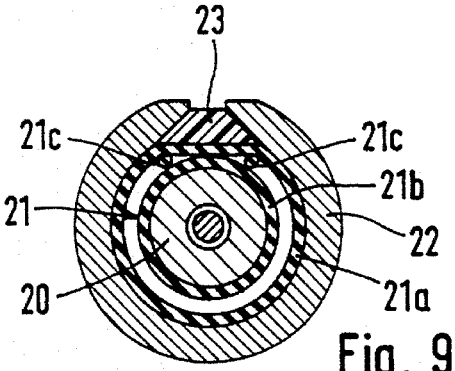
FIG. 9 is a cross sectional view of a conventional rodless cylinder.
Figure 10:
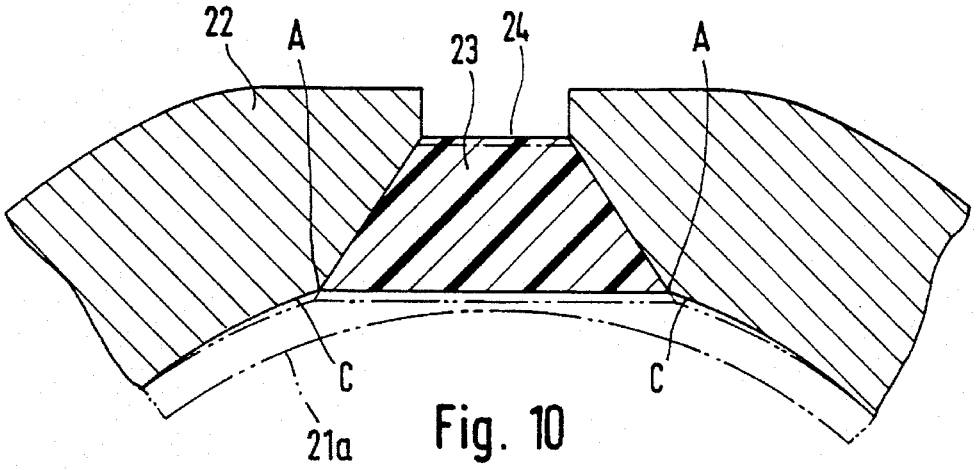
FIG. 10 is a partial sectional view of conventional cylinder tube and trapezoidal belt.

The dust seal belt 16 is a belt of the type which closes the slit 3 in the cylinder tube 1 from the outside to seal dust and consists of a belt-shaped stainless steel plate and a projection 16*a* of synthetic resin which is attached onto the lower surface of the stainless steel plate as shown in FIG. 8.

The dust seal belt 16 is fixed to the inside of the head cover 2 at the both ends thereof in the same manner as the trapezoidal belt 4 and is provided so as to run along the upper groove in the coupling member 11 to close the outside of the slit 3 in the longitudinal direction. The projection 16*a* under the dust seal belt 16 which is in a position in which it closes the slit 3 is nipped and held by the projection strips 13, 13 on the both sides thereof within the slit 3.

In the rodless cylinder which is constructed as mentioned above, an air supply hose is connected to an air supply port provided on the head cover 2 thereof and an object to be driven is coupled to the plate 14 on the coupling member 11 projecting from the cylinder tube 1. Then, when pressure fluid is supplied from the air supply port, fluid pressure is applied to the right end of the piston 5 in FIG. 1, by which the piston 5 is moved to the left. The trapezoidal belt 4 is nipped by the projection strips 12, 12 within the slit, so that the trapezoidal belt 4 never hangs down into the cylinder tube 1 and the fluid pressure thus applied pushes the trapezoidal belt 4 into the slit 3 from the inside thereof to securely seal the slit 3.

Within the piston, the piston cups 10 seal the boundaries among the piston 5, the inner periphery of the cylinder tube 1 and the bottom of the trapezoidal belt 4. In general, the upper part of the piston cup 10 is pushed against the bottom of the trapezoidal belt 4 and hence is deformed, by which a gap is readily formed in the vicinity of the both sides of the bottom of the trapezoidal belt 4, that is, on an outer peripheral portion of the outer lip 10*b* shifting from an arced part to a flat part. However, in the present invention, this portion is reinforced by the ribs 10*c* to prevent the inward inclination of the outer lip 10*b*, by which the boundary between the outer lip 10*b* in the vicinity of the both sides of the bottom of the trapezoidal belt 4 and the inner periphery of the cylinder tube 1 can be favorably sealed.

Further, both of the side walls of the slit 3 are formed into convexly curved configurations and the both side walls of the slit 3 are connected to the inner periphery of the cylinder tube 1 forming the smooth curve, so that even when the lower angulated part of the trapezoidal belt 4 slightly projects inward from the inner periphery of the cylinder tube due to the tolerance in size of the trapezoidal belt 4 and the slit 3, no gap is created between the outer lip 10*b* of the piston cup 10 and the inner periphery of the cylinder tube 1 and hence the leak of the pressure fluid can be minimized.

On the other hand, in association with the movement of the piston 5, the positions of the trapezoidal belt 4 and the dust seal belt 16 which enter the piston shift to the left and the remaining section of the trapezoidal belt 4 is pushed against the slit of the trapezoidal section by the end block 7 and the fluid pressure within the cylinder and fitted into the slit, and the dust seal belt 16 is pressed down by the dust scraper 15 to be fitted into the upper part of the slit 3, by which the slit 3 is dust-sealed with the dust seal belt 16 and is favorably sealed with the trapezoidal belt 4.

The trapezoidal belt 4 has the almost trapezoidal section, so that the higher the pressure within the cylinder is, the more the pushing force of the trapezoidal belt 4 is increased and hence the favorable sealing can be attained. In addition, the actuating force of the piston 5 is hardly applied to the trapezoidal belt 4, so that the trapezoidal belt 4 never expands and contracts and hence no harmful effect is induced by the expansion and contraction of the trapezoidal belt 4.

Compressed air is appropriate as the source of pressure for the rodless cylinder of the present invention. However, this rodless cylinder can be used at a lower hydraulic pressure.

As has been described above, according to the rodless cylinder of the present invention, both of the side walls of the slit of the almost trapezoidal section are formed into the convexly curved configurations and the both side walls of the slit are connected to the inner peripheral surface of the cylinder tube forming the smooth curve, so that even when the trapezoidal belt is not correctly fitted into the slit due to the tolerance in size of the trapezoidal belt and the slit and due to the invasion of dust and hence the lower angulated part of the trapezoidal belt slightly projects inward from the inner periphery of the cylinder tube, no gap is formed between the outer lip of the piston cup and the inner peripheral surface of the cylinder tube, by which the leak of the pressure fluid from within the cylinder tube can be reduced.

In addition, the projection strips for nipping and holding the trapezoidal belt therebetween are formed on the both upper side walls of the slit of the almost trapezoidal section, so that the section of the trapezoidal belt which is in the position separated from the piston within the cylinder tube is nipped between the projection strips to be correctly held within the slit, by which the hanging of the belt down into the cylinder tube can be prevented and the leak of the pressure fluid through the slit can be reduced.

The present invention has been described in relation to the preferred embodiment thereof. However, the present invention is not limited thereto but can be varied and modified in a variety of ways without departing from the scope and spirit of the present invention defined in the appended claims.

What is claimed is:

1. A rodless cylinder capable of minimizing the leakage of pressure fluid therefrom comprising:

a cylinder tube having a substantially trapezoidal-shaped slit formed along its longitudinal length, said slit including convexly-curved side walls;

a piston slidably positioned in said cylinder tube;

a substantially trapezoidal-shaped belt positioned to sealingly engage said slit, said belt having a pair of opposing concavely-curved surfaces adjoining said convexly-curved side walls of said slit;

annular sealing means fitted onto the outer periphery of said piston for providing a seal between said piston and said cylinder tube; and wherein said side walls of said slit and the inner periphery of said cylinder tube adjoin one another in such a manner as to form a smooth curve; and wherein said sealing means includes at least one rib positioned radially inward from and proximal said smooth curve for forcing said sealing means into sealing contact with said belt and for forcing said belt into sealing contact with said smooth curve of said cylinder tube when said cylinder tube is pressurized.

2. The rodless cylinder according to claim 1, wherein said walls include projecting strips for nipping and holding said belt.

3. The rodless cylinder according to claim 1, wherein said sealing means is a piston cup.

* * * * *